US005765244A

United States Patent [19]

Heidler

[11] Patent Number: 5,765,244

[45] Date of Patent: Jun. 16, 1998

[54] PORTABLE BACK REST

[76] Inventor: Jon D. Heidler, 865 Adams Ave., Chillicothe, Ohio 45601

[21] Appl. No.: 888,021

[22] Filed: Jul. 3, 1997

Related U.S. Application Data

[63] Continuation-in-part of Ser. No. 666,610, Jun. 18, 1996, abandoned.

[51] Int. Cl.[6] ..... A47C 20/04

[52] U.S. Cl. ..... 5/634; 5/633; 5/630; 5/733

[58] Field of Search ..... 297/31, 252, 352, 297/377; 5/634, 633, 630, 733

[56] References Cited

U.S. PATENT DOCUMENTS

| | | | |
|---|---|---|---|
| 468,873 | 2/1892 | Hardendorf | 297/252 |
| 2,040,942 | 2/1936 | Katenkamp | 297/31 |
| 2,560,457 | 1/1951 | Litten | 297/252 |
| 5,246,265 | 9/1993 | Nagen et al. | 297/31 |

*Primary Examiner*—Brian K. Green
*Assistant Examiner*—Fredrick Conley
*Attorney, Agent, or Firm*—David L. Volk

[57] ABSTRACT

A generally u-shaped first structure comprises a first lateral member and two first legs. A generally u-shaped second structure comprises a second lateral member and two second legs. Two connecting legs are provided, each connecting leg being pivotally attached to one of the first legs and to one of the second legs, such that the first structure remains generally parallel to the second structure as the first structure is pivoted toward and away from the second structure. A generally u-shaped third structure comprises a third lateral member and two third legs. The two third legs of the third structure are pivotally attached to one of the second legs of the second structure. A pair of support members extend between the second legs of the second structure. Each of the support members has a plurality of spaced pins extending there-from. A pair of arms is provided, each of the arms having a first end pivotally attached to one of the third legs of the third structure. Each of the arms has a second end configured to receive one of the pins therein. Each of the arms is configured to extend between the third structure and a selected one of the pins, the third structure thus being supported at an adjustable angle from the second structure.

12 Claims, 3 Drawing Sheets

PORTABLE BACK REST

CROSS-REFERENCE TO RELATED APPLICATIONS

This application is a continuation-in-part of application Ser. No. 08/666,610, filed Apr. 8, 1996, now abandoned.

BACKGROUND OF THE INVENTION

1. Field of the Invention

The present invention relates to back rests, particularly to back rests which attach to an article of furniture on which a person reclines.

2. Description of the Related Art

Generally, when a person wants to sit up in bed for reading, watching television, or to carry on a conversation, he or she props a pillow between his or her back and the headboard of the bed, to provide a back rest. This provides an uncomfortable and unstable back rest, at best.

What is needed is a portable, easily used, adjustable back rest that can be used on any conventional bed mattress, and which provides a comfortable and stable support.

SUMMARY OF THE INVENTION

The back rest of the present invention includes a generally u-shaped first structure comprising a first lateral member and two first legs. A generally u-shaped second structure comprises a second lateral member and two second legs. Two connecting legs are provided, each connecting leg being pivotally attached to one of the first legs and to one of the second legs, such that the first structure remains generally parallel to the second structure as the first structure is pivoted toward and away from the second structure.

A generally u-shaped third structure comprises a third lateral member and two third legs. The two third legs of the third structure are pivotally attached to one of the second legs of the second structure. A pair of support members extend between the second legs of the second structure. Each of the support members has a plurality of spaced pins extending there-from. A pair of arms is provided, each of the arms having a first end pivotally attached to one of the third legs of the third structure. Each of the arms has a second end configured to receive one of the pins therein. Each of the arms is configured to extend between the third structure and a selected one of the pins, the third structure thus being supported at an adjustable angle from the second structure.

A cushion has a sleeved cover configured to receive a distal portion of the third structure therein, the cushion thus being retained on the third structure and providing a cushioned back support for a human reclining there-against.

The second structure is adapted to rest flatly on a mattress. The first structure is adapted to rest flatly beneath the mattress, between the mattress and a supporting box spring, and the connecting legs are adapted to extend across a width of the mattress between the first structure and the second structure.

Because the third structure is pivotally attached to the second structure, and because the second structure is pivotally attached to the second structure, the entire apparatus may be folded substantially flat for storage and transport.

Because the second structure rests flatly on a top surface of a mattress, the first structure rests between a bottom of the mattress and a supporting box spring, and the third structure is supported from the second structure, the present invention provides a stable and secure back rest.

Because the cushion is configured to attach to the third structure, the back rest of the present invention provides a comfortable, cushioned support for a person's back.

Still further features and advantages will become apparent from the ensuing description and drawings.

DETAILED DESCRIPTION

Figure 1:
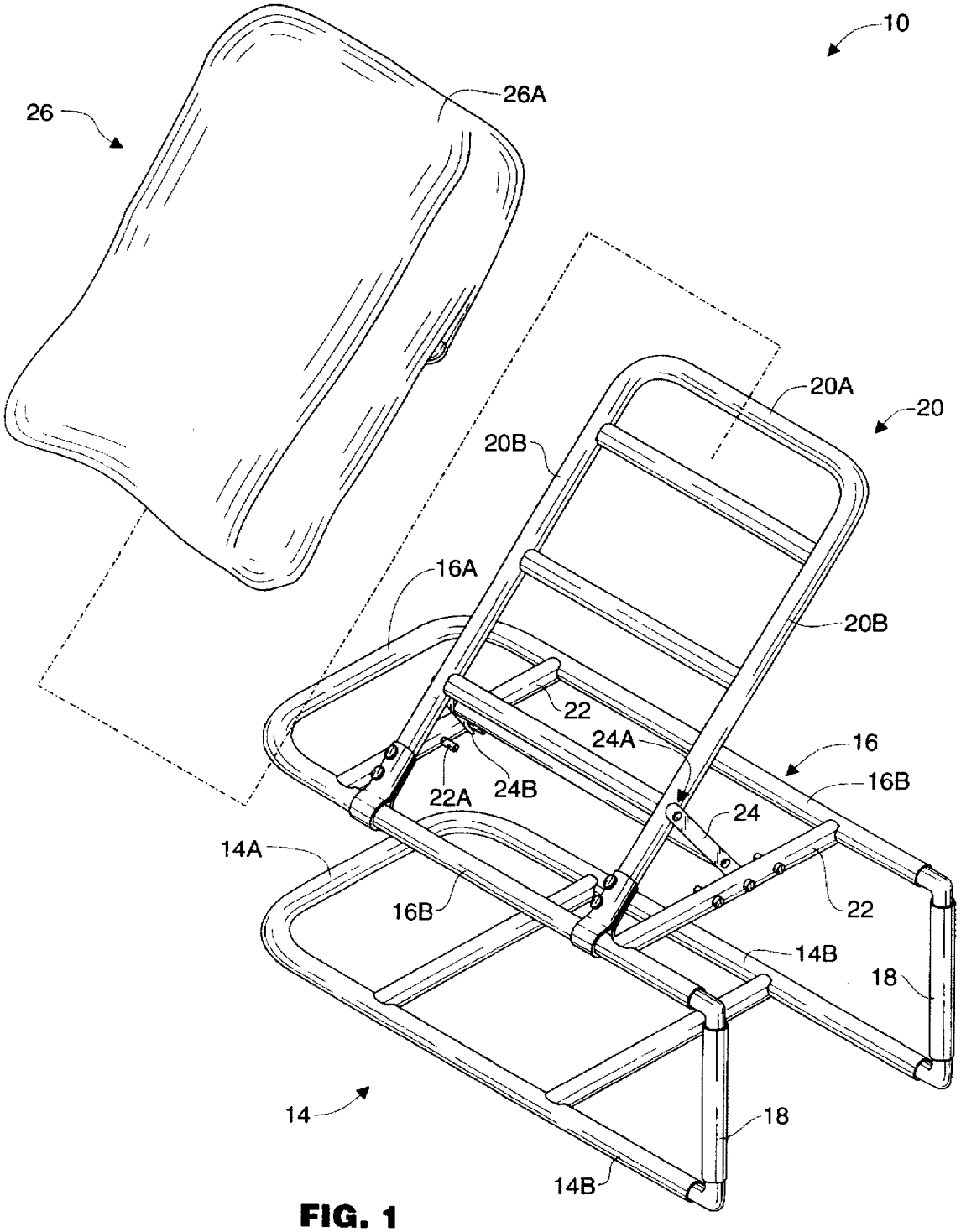
FIG. 1 is a perspective view of a back rest of the present invention.
Figure 2:
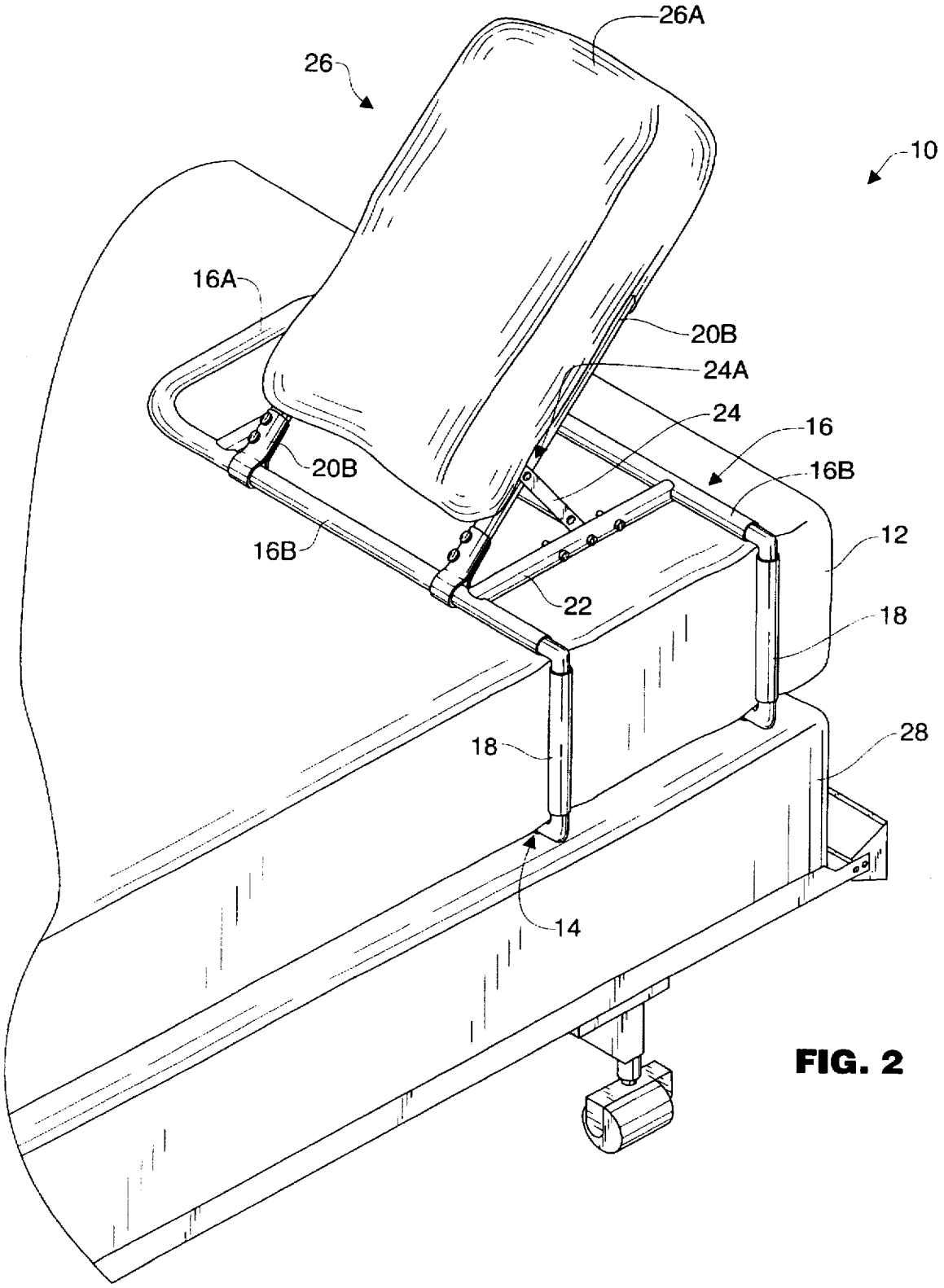
FIG. 2 is a perspective view of the back rest, shown attached to a mattress and ready for use.
Figure 3:
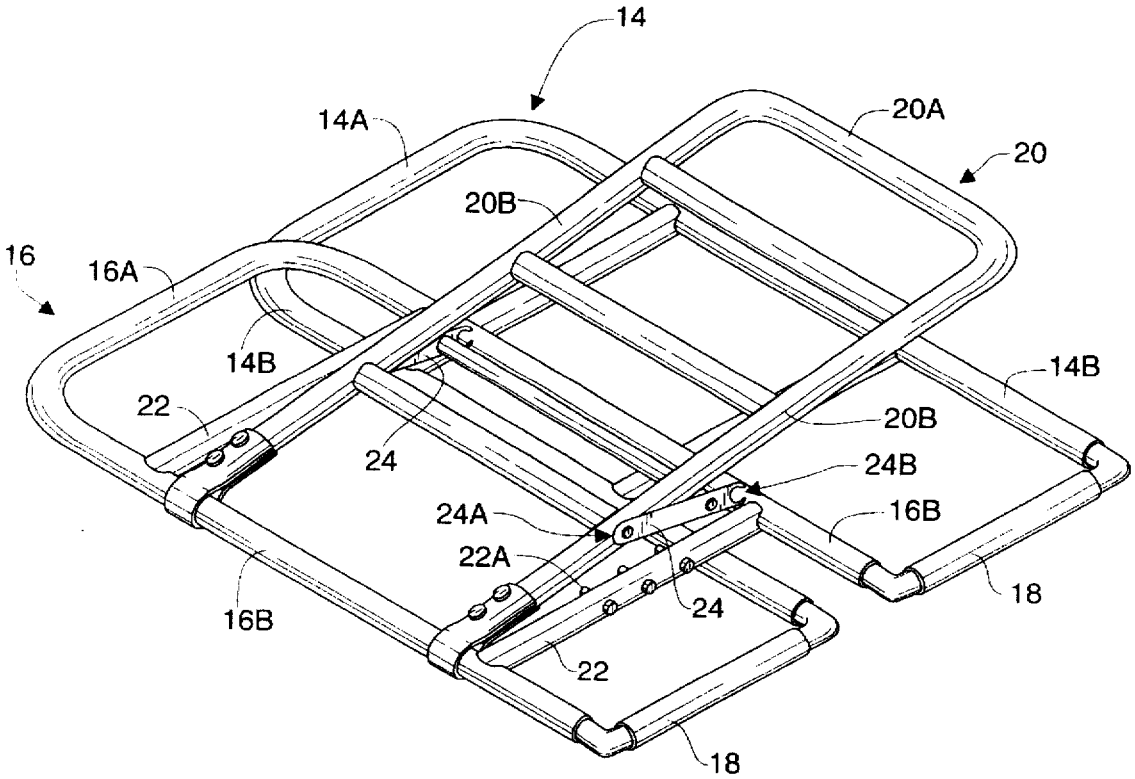
FIG. 3 is a perspective view of the back rest in a folded condition.

FIG. 1 is a perspective view of a back rest 10 of the present invention. FIG. 2 is a perspective view of the back rest 10, shown attached to a mattress 12 and ready for use. FIG. 3 is a perspective view of the back rest 10 in a folded condition. Referring to FIGS. 1–3, the back rest 10 includes a generally u-shaped first structure 14 comprising a first lateral member 14A and two first legs 14B.

A generally u-shaped second structure 16 comprises a second lateral member 16A and two second legs 16B. Two connecting legs 18 are provided, each connecting leg being pivotally attached to one of the first legs 14B and to one of the second legs 16B, such that the first structure 14 remains generally parallel to the second structure 16 as the first structure 14 is pivoted toward and away from the second structure 16.

A generally u-shaped third structure 20 comprises a third lateral member 20A and two third legs 20B. The two third legs 20B of the third structure 20 are pivotally attached to one of the second legs 16B of the second structure 16. A pair of support members 22 extend between the second legs 16B of the second structure 16. Each of the support members 22 has a plurality of spaced pins 22A extending there-from.

A pair of arms 24 is provided, each of the arms 24 having a first end 24A pivotally attached to one of the third legs 20B of the third structure 20. Each of the arms 24 has a second end 24 B configured to receive one of the pins 22A therein. Each of the arms 24 is configured to extend between the third structure 20 and a selected one of the pins 22A, the third structure 20 thus being supported at an adjustable angle from the second structure 16. Other known methods of providing adjustable support for the third structure 20 are within the scope of the present invention.

A cushion 26 has a sleeved cover 26A configured to receive a distal portion of the third structure 20 therein, the cushion 26 thus being retained on the third structure 20 and providing a cushioned back support for a human reclining there-against.

The second structure 16 is adapted to rest flatly on the mattress 12. The first structure 14 is adapted to rest flatly beneath the mattress 12, between the mattress 12 and a supporting box spring 28, and the connecting legs 18 are adapted to extend across a width of the mattress 12 between the first structure 14 and the second structure 16.

The foregoing description is included to describe embodiments of the present invention which include the preferred embodiment, and is not meant to limit the scope of the invention. From the foregoing description, many variations will be apparent to those skilled in the art that would be encompassed by the spirit and scope of the invention. For example, the present invention could be adapted for use with articles of furniture other than beds, such as benches and couches. Additionally, structures other than u-shaped are possible. Accordingly, the scope of the invention is to be limited only by the following claims and their legal equivalents.

The invention claimed is:

1. A back rest comprising:

a. a generally u-shaped first structure comprising a first lateral member and two first legs;

b. a generally u-shaped second structure comprising a second lateral member and two second legs;

c. attachment means for pivotally attaching the first structure to the second structure such that the first structure remains generally parallel to the second structure as the first structure is pivoted toward and away from the second structure;

d. a generally u-shaped third structure comprising a third lateral member and two third legs;

e. the two third legs of the third structure being pivotally attached to one of the second legs of the second structure; and f. support means for supporting the third structure at an adjustable angle from the second structure.

2. The back rest of claim 1, further comprising a cushion having a sleeved cover configured to receive a distal portion of the third structure therein, the cushion thus being retained on the third structure and providing a cushioned back support for a human reclining thereagainst.

3. The back rest of claim 1, wherein the attachment means comprises two connecting legs, each connecting leg being pivotally attached to one of the first legs and to one of the second legs.

4. The back rest of claim 3, wherein the second structure is adapted to rest flatly on a mattress, the first structure is adapted to rest flatly beneath the mattress, and the connecting legs are adapted to extend across a width of the mattress between the first structure and the second structure.

5. The back rest of claim 1, wherein the support means comprises:

a. a pair of support members extending between the second legs of the second structure;

b. each of the support members having a plurality of spaced pins extending therefrom;

c. a pair of arms, each of the arms having a first end pivotally attached to one of the third legs of the third structure;

d. each of the arms having a second end configured to receive one of the pins therein; and e. each of the arms configured to extend between the third structure and a selected one of the pins.

6. A back rest comprising:

a. a generally u-shaped first structure comprising a first lateral member and two first legs;

b. a generally u-shaped second structure comprising a second lateral member and two second legs;

c. two connecting legs, each connecting leg being pivotally attached to one of the first legs and to one of the second legs, such that the first structure remains generally parallel to the second structure as the first structure is pivoted toward and away from the second structure;

d. a generally u-shaped third structure comprising a third lateral member and two third legs;

e. the two third legs of the third structure being pivotally attached to one of the second legs of the second structure;

f. support means for supporting the third structure at an adjustable angle from the second structure;

g. a cushion having a sleeved cover configured to receive a distal portion of the third structure therein, the cushion thus being retained on the third structure and providing a cushioned back support for a human reclining there-against;

h. the second structure adapted to rest flatly on a mattress;

i. the first structure adapted to rest flatly beneath the mattress; and j. the connecting legs adapted to extend across a width of the mattress between the first structure and the second structure.

7. The back rest of claim 6, wherein the support means comprises:

a. a pair of support members extending between the second legs of the second structure;

b. each of the support members having a plurality of spaced pins extending therefrom;

c. a pair of arms, each of the arms having a first end pivotally attached to one of the third legs of the third structure;

d. each of the arms having a second end configured to receive one of the pins therein; and e. each of the arms configured to extend between the third structure and a selected one of the pins.

8. A back rest comprising:

a. a first structure comprising two, generally parallel first legs connected to each other by a first lateral member;

b. a second structure comprising two, generally parallel second legs connected to each other by a second lateral member;

c. attachment means for pivotally attaching the first structure to the second structure such that the first structure remains generally parallel to the second structure as the first structure is pivoted toward and away from the second structure;

d. a third structure comprising two, generally parallel third legs connected to each other by a third lateral member;

e. the two third legs of the third structure being pivotally attached to one of the second legs of the second structure; and f. support means for supporting the third structure at an adjustable angle from the second structure.

9. The back rest of claim 8, further comprising a cushion having a sleeved cover configured to receive a distal portion of the third structure therein, the cushion thus being retained on the third structure and providing a cushioned back support for a human reclining thereagainst.

10. The back rest of claim 8, wherein the attachment means comprises two connecting legs, each connecting leg being pivotally attached to one of the first legs and to one of the second legs.

11. The back rest of claim 10, wherein the second structure is adapted to rest flatly on a mattress, the first structure is adapted to rest flatly beneath the mattress, and the connecting legs are adapted to extend across a width of the mattress between the first structure and the second structure.

12. The back rest of claim 8, wherein the support means comprises:

a. a pair of support members extending between the second legs of the second structure;

b. each of the support members having a plurality of spaced pins extending therefrom;

c. a pair of arms, each of the arms having a first end pivotally attached to one of the third legs of the third structure;

d. each of the arms having a second end configured to receive one of the pins therein; and e. each of the arms configured to extend between the third structure and a selected one of the pins.

* * * * *